US007876295B2

(12) United States Patent
Marx

(10) Patent No.: US 7,876,295 B2
(45) Date of Patent: Jan. 25, 2011

(54) CIRCUIT AND METHOD FOR DRIVING A LIGHT-EMITTING DISPLAY

(75) Inventor: Thilo Marx, Villingen-Schwenningen (DE)

(73) Assignee: Thomson Licensing, Boulogne-Billancourt ( * ) Notice: Subject to any disclaimer, the term of this patent is extended or adjusted under 35 U.S.C. 154(b) by 410 days.

(21) Appl. No.: 10/583,822

(22) PCT Filed: Nov. 18, 2004

(86) PCT No.: PCT/EP2004/013124

§ 371 (c)(1),
(2), (4) Date: Jun. 21, 2006

(87) PCT Pub. No.: WO2005/064582

PCT Pub. Date: Jul. 14, 2005

(65) Prior Publication Data

US 2007/0120796 A1 May 31, 2007

(30) Foreign Application Priority Data

Dec. 23, 2003 (DE) ..... 103 60 816

(51) Int. Cl.
*G09G 3/30* (2006.01)

(52) U.S. Cl. ..... 345/77; 345/76; 345/82; 345/83

(58) Field of Classification Search ..... 345/76, 345/77, 82, 83
See application file for complete search history.

(56) References Cited

U.S. PATENT DOCUMENTS 6,091,203 A 7/2000 Kawashima et al.
6,236,252 B1 5/2001 Genest et al.
6,246,180 B1 6/2001 Nishigaki
6,498,438 B1 12/2002 Edwards
6,501,466 B1 * 12/2002 Yamagishi et al. ..... 345/204
6,859,193 B1 * 2/2005 Yumoto ..... 345/82
6,917,350 B2 * 7/2005 Pae et al. ..... 345/55
6,992,647 B2 * 1/2006 Hanada et al. ..... 345/76

(Continued)

FOREIGN PATENT DOCUMENTS

EP 1102234 5/2001

(Continued)

OTHER PUBLICATIONS

J-H Lee et al. "OLED Pixel Design Employing a Novel Current Scaling Scheme", 2003 SID Int'l Symposium Digest of Technical Papers, Baltimore, MD May 20-22, 2003, vol. vol. 34/1, pp. 490-493.

(Continued)

*Primary Examiner*—Quan-Zhen Wang
*Assistant Examiner*—Robert R Rainey
(74) *Attorney, Agent, or Firm*—Robert D. Shedd; Harvey D. Fried; James McKenzie

(57) ABSTRACT

The invention proposes a circuit for an element of a light-emitting display. The element comprises a current control means, first and second switching means and a light-emitting means. In one embodiment, a signal holding means is provided. In addition, a light-emitting display having a plurality of elements is proposed. Furthermore, a method for driving the elements and the light-emitting display is proposed, and also a control signal for use with the method.

11 Claims, 9 Drawing Sheets

U.S. PATENT DOCUMENTS

| | | | | |
|---|---|---|---|---|
| 7,138,967 | B2 * | 11/2006 | Kimura | 345/76 |
| 2002/0005825 | A1 | 1/2002 | Lee et al. | |
| 2002/0126073 | A1 | 9/2002 | Knapp et al. | |
| 2002/0130827 | A1 | 9/2002 | Maurice | |
| 2003/0067455 | A1 | 4/2003 | Kasai | |
| 2003/0076285 | A1 * | 4/2003 | Albu et al. | 345/87 |
| 2003/0107560 | A1 * | 6/2003 | Yumoto et al. | 345/204 |
| 2005/0151705 | A1 * | 7/2005 | Fish | 345/76 |
| 2006/0038758 | A1 * | 2/2006 | Routley et al. | 345/81 |
| 2006/0250331 | A1 * | 11/2006 | Sempel et al. | 345/76 |

FOREIGN PATENT DOCUMENTS

| | | |
|---|---|---|
| EP | 1130565 | 9/2001 |
| EP | 1353316 | 10/2003 |
| GB | 2389951 | 12/2003 |
| WO | WO 02/071379 | 9/2002 |
| WO | WO03077230 | 9/2003 |

OTHER PUBLICATIONS

A. Yumoto et al. "Pixel-Driving Methods for Large-Sized Poly-Si AM-OLED Displays", Asia Display/IDW'01, Proceedings of the 21st International Display Research Conference in Conjunction With the 8th International Display Workshops, Nagoya, Japan, Oct. 16-19, 2001, vol. CONF. 21/8, Oct. 16, 2001, pp. 1395-1398.

Search Report Dated Jun. 28, 2005.

* cited by examiner

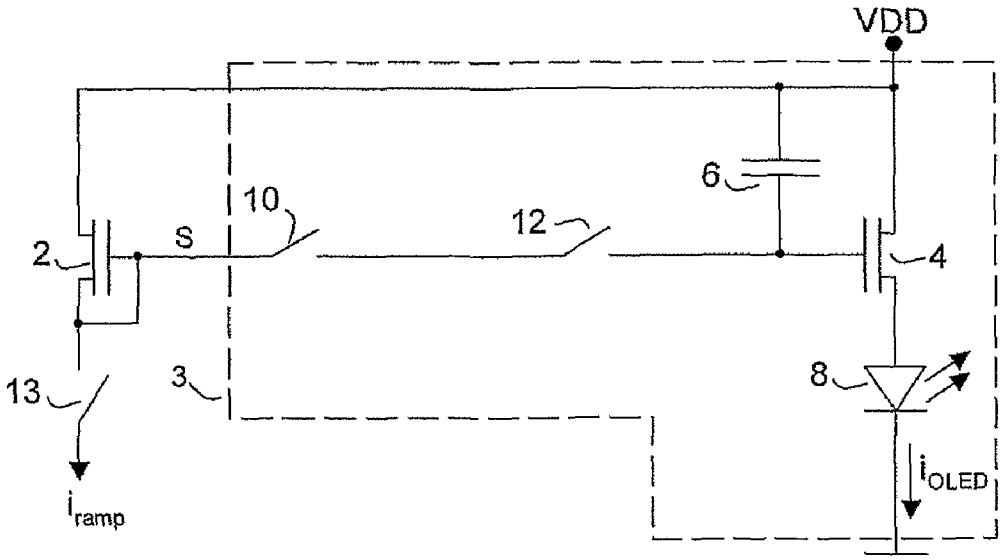
Fig. 9
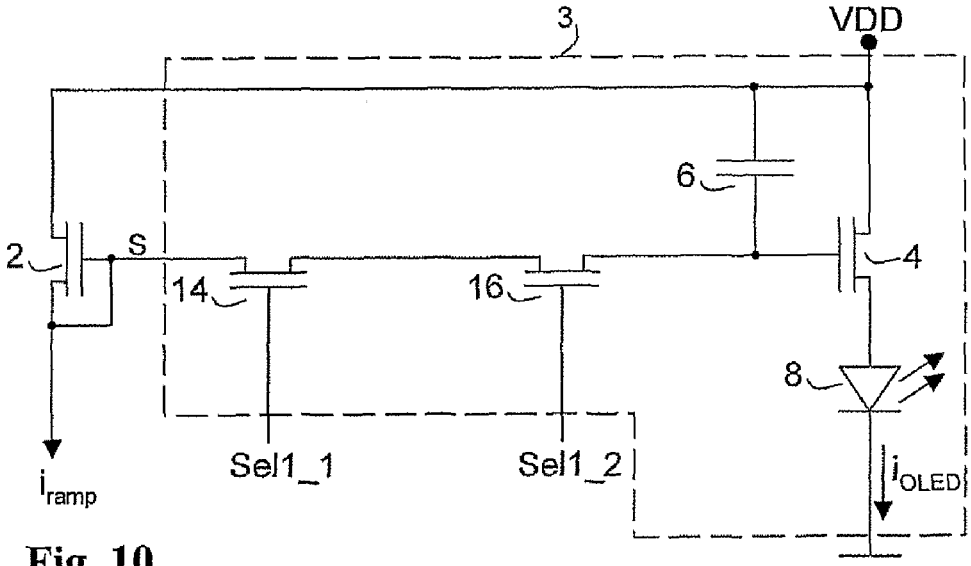
Fig. 10
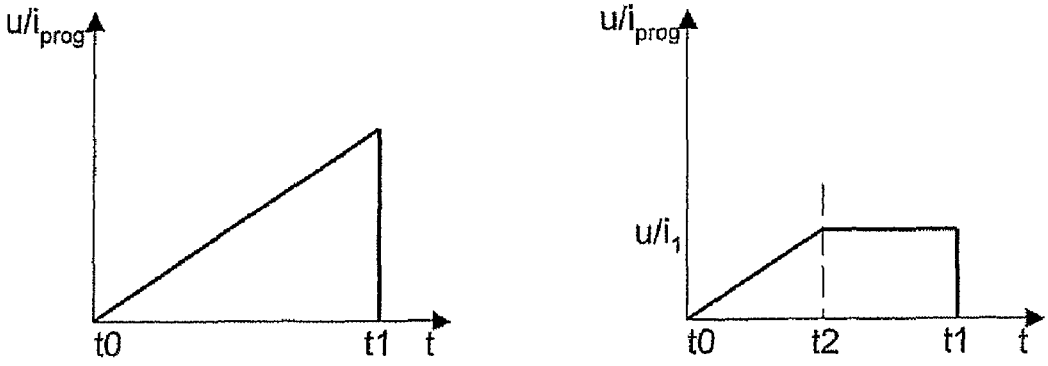
Fig. 11 a) b)

CIRCUIT AND METHOD FOR DRIVING A LIGHT-EMITTING DISPLAY

This application claims the benefit, under 35 U.S.C. §365 of International Application PCT/EP2004/013124, filed Nov. 18, 2004, which was published in accordance with PCT Article 21(2) on Jul. 14, 2005 in English and which claims the benefit of German patent application No. 10360816.8, filed Dec. 23, 2003.

The invention relates to a circuit for an element of a light-emitting display and to a circuit for a light-emitting display having a plurality of elements. The invention also relates to a method for driving the elements of a light-emitting display and to a signal for use in the method.

Light-emitting displays, which produce light using light-emitting elements through which a current flows, contain a multiplicity of light-emitting elements in a suitable arrangement. In this context, the light-emitting elements output a luminous flux which is dependent on the electrical current flowing through them. The term luminous flux describes the total radiative power of the light source. The text below uses the term current to represent the electrical current. In the case of a matrix arrangement comprising a plurality of light-emitting elements, monochromic or polychromic images are represented by a plurality of pixels. In the case of monochromic images, the images are resolved into individual grey-scale values for the pixels. In this context, the grey-scale values are different luminous flux values. The different luminous flux values are produced by corresponding currents through the light-emitting elements. In the case of a polychromic light-emitting display, a plurality of light-emitting elements of different colours normally interact. Using additive colour mixing for each pixel, it is possible to produce colours that are different from the original colours of the light-emitting elements. The light-emitting elements include light-emitting diodes, inter alia. Light-emitting diodes can be produced on the basis of semiconductive materials (e.g. silicon, germanium), but light-emitting diodes based on organic materials (OLED, "organic light-emitting diode") are also available. A common feature of all of these light-emitting diodes is that the luminous flux which is output is dependent on the electrical current through the light-emitting element.

Particularly in the case of organic light-emitting diodes (OLED), the current/voltage characteristic is greatly dependent upon the ageing and on process parameters during production.

In organic light-emitting diodes, light is produced by passing a direct current through the organic diode material. In this case, the organic light-emitting diode is forward-biased. It has been found that the forward voltage of the OLED may vary from pixel to pixel and increases over time. It has likewise been found that the current for generating a particular luminous flux remains relatively stable over time.

Therefore, when a control voltage is used for driving, it is necessary to take account of the ageing-related alteration in the forward voltage of the OLED.

It has been found that in the case of certain production methods for organic light-emitting diodes the electro-optical properties of individual light-emitting elements are essentially the same across a certain area. In this context, the term electro-optical properties relates to the current/voltage characteristic and the associated luminous fluxes. Suitable control of the production methods allows these areas of essentially the same electro-optical properties to be shaped such that these areas extend over light-emitting elements which are arranged in lines and/or columns. The driving scheme may thus involve a correction value being provided for the respective areas of essentially the same electro-optical properties.

Another method for compensating for the time-dependent electro-optical properties involves the driving being performed using control currents. To this end, each light-emitting element, that is to say each organic light-emitting diode, for example, has a first current control means connected upstream of it. The first current control means is connected to a second current control means in such a manner that a current mirror circuit is obtained. In the case of the current mirror circuit, the second current control means has a reference current flowing through it, with a corresponding control signal establishing on a control electrode on the second current control means. This control signal is supplied to the control electrode of the first current control means. If the first and second current control means have essentially the same properties, the current through the first current control means corresponds to the current through the second current control means. The same properties of the two current control means compensate for thermal, production-related and ageing-related changes.

In another embodiment of current mirrors, it is possible for the mirrored current to be put in a particular ratio to the reference current. This embodiment of a current mirror will be explained with reference to FIG. 4. FIG. 4 shows a current control means 2 which has a reference current $i_{ref}$ flowing through it. The control electrode of the current control means 2 is connected to the control electrodes of further current control means 4, 4', 4". The mirrored currents through the further current control means 4, 4', 4" are denoted by the reference symbols $i_m$, $i_{m'}$, $i_{m''}$ in the figure. If the further current control means 4, 4', 4" are identical, then the currents flowing through them are likewise identical. If the current control means 2 is likewise identical to the further current control means, then all currents are identical. A desired mirrored current can now be set by adding the mirrored currents.

In a further embodiment of the current mirror, the properties of the current control means 2 and the properties of the current control means 4, 4', 4" are chosen such that the currents $i_{ref}$, $i_m$, $i_{m'}$ and $i_{m''}$ are each in a particular ratio to one another.

The use of an appropriate current mirror allows the currents required for control and the currents through the light-emitting elements to be chosen independently of one another. In this way, it is possible, by way of example, to increase the currents required for control, while the currents through the light-emitting elements are in an advantageous range. In addition, this allows areas with different electro-optical properties to be individually set such that the required range of the control currents remains limited and nevertheless all elements can be driven fully.

In the case of light-emitting displays for rendering large-area images, e.g. in television sets, the images are produced in non-interlaced or in interlaced format. Non-interlaced or interlaced images are also called "frames" and "fields", respectively. In this case, the image area is split virtually and/or physically into lines and/or columns. In the case of image rendition using interlaced images, a partial image is then first rendered which, by way of example, comprises only the even or only the odd lines of the total image. Next, the other interlaced image is rendered. In the case of non-interlaced rendition, the total image is set up. Interlaced rendition is also called "interlaced scan", and non-interlaced rendition is called "progressive scan". When rendering moving images, the non-interlaced or interlaced displays are also replaced at regular intervals by respective other images which have an altered image content, in order to create the impression of fluid movements as a result. In this case, the frame frequency is dependent on a respective television standard, for example.

In today's light-emitting displays, which comprise light-emitting elements that are arranged in a matrix arrangement and that have individual current control means, the individual light-emitting elements are driven successively in lines or columns. A light-emitting element for such driving is shown in FIG. 1. A current control means 4 is connected in series with a light-emitting element 8 between an operating voltage VDD and earth. A control signal is supplied to a control input on the current control means 4 via a switch 12. In this case, the control signal is a control voltage $U_{set}$. The switch 12 is controlled in this example such that only a single light-emitting element in an arrangement of light-emitting elements is respectively driven. In the driving scheme which is required for this circuit, the period of time during which the light-emitting diode radiates light is relatively short. Depending on how many light-emitting elements there are in the arrangement of the light-emitting display, the active period of time is reduced. Since the human eye is a natural system with a low-pass filter response, it is possible to compensate for the short active period of time by appropriately increasing the luminous flux during the active period of time.

It is also conceivable to have light-emitting displays in which each current control means is permanently actuated using a control signal. The switch 12 can then be dispensed with. However, the multiplicity of control lines required reduces the area available for light to emerge on the screen.

In the case of the light-emitting element shown in FIG. 2, a signal holding means 6 has been added to the circuit described above between the control electrode of the current control means 4 and the operating voltage VDD. The control signal $U_{set}$ applied when the switch 12 is closed is held constant by the signal holding means 6 when the switch is open until a new control signal $U_{set}$ is applied. This makes it possible to extend the active period of time during which the light-emitting element 8 radiates light. The active period of time now extends over almost the entire period during which an image is set up. This reduces the required luminous flux, which must be radiated during the active period of time. Since the eye of the observer is now able to integrate a smaller luminous flux over a longer period of time, the same quantity of light is picked up and the same image impression as described with reference to FIG. 1 is obtained.

FIG. 3 shows an element of a light-emitting display as was described in FIG. 2. The element is marked by a dashed frame 1. In this example, the control signal S is taken from the control electrode of a current control means 2. When the switch 12 is closed, the current control means 2 forms a current mirror circuit with the current control means 4 of the element 1. In a light-emitting display comprising a plurality of elements 1 in a grid arrangement, each element 1 is supplied an individual control signal depending of the image content. To this end, a respective control current $i_{prog}$ is impressed on the current control means 2. A control circuit which is not shown in FIG. 3 successively actuates the switches 12 of the various elements 1 of the light-emitting display.

It is now desirable to simplify the driving of light-emitting displays with light-emitting elements of the type described above. It is also desirable to specify an improved control signal for driving light-emitting elements. Finally, it is desirable to specify an improved method for driving light-emitting elements.

To this end, an element of a light-emitting display according to the invention has a current control means which is connected in series with a light-emitting means. A control line associated with the current control means includes a first and a second switching means arranged in series. In a further embodiment, the current control means additionally has an associated signal holding means. When the first and second switching means are closed, a control signal according to the invention is applied to the current control means. In the case of elements arranged in a grid comprising columns and lines, one switching means selects the line and one switching means selects the column in which the element is arranged. The current control means controls an electrical current which flows through the light-emitting means. The light-emitting means emits a luminous flux which is dependent on the electrical current. When the luminous flux reaches a desired magnitude, one of the two switching means is opened. In the case of actuation in lines, that switching means which selects the column is opened first. In the case of actuation in columns, it is accordingly that switching means which selects the line.

The control signal used has a constantly rising profile, for example a ramp shape. Between two cycles for driving, there may be idle times during which the control signal remains essentially unchanged.

The invention will be described in more detail below with reference to the appended drawing, in which FIG. 1 shows a circuit for an element of a light-emitting display as is known from the prior art;

FIG. 9 shows a development of the inventive light-emitting display;

FIG. 10 shows a specific exemplary embodiment of the inventive element from FIG. 7;

Figure 12:
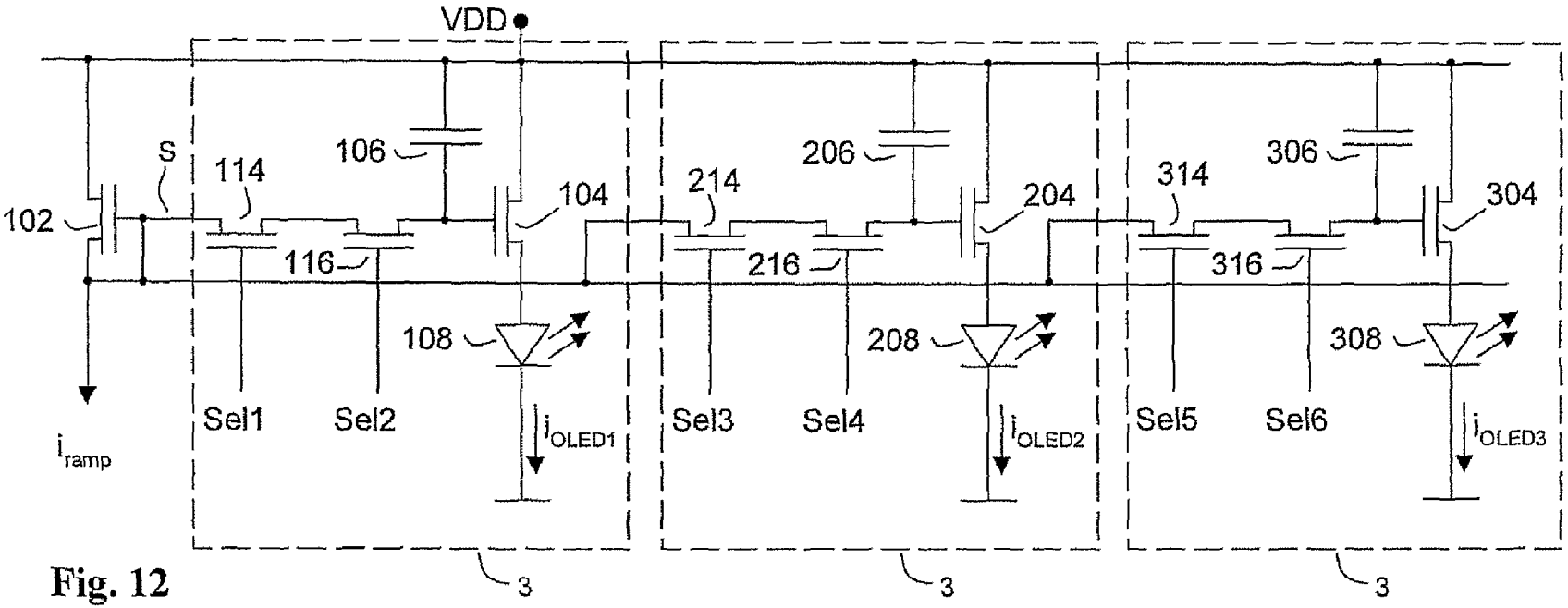
Figure 13:
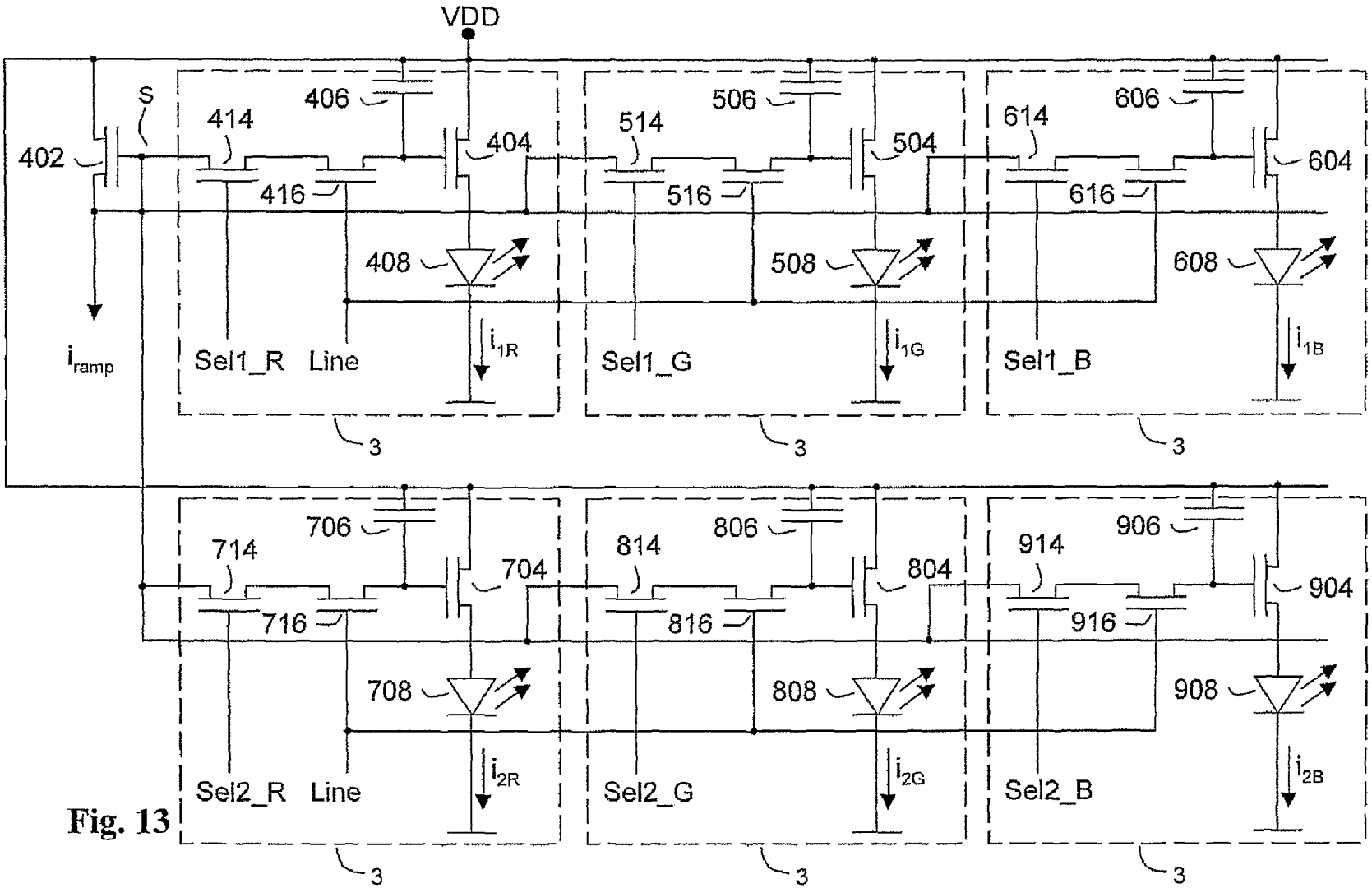
Figure 14:
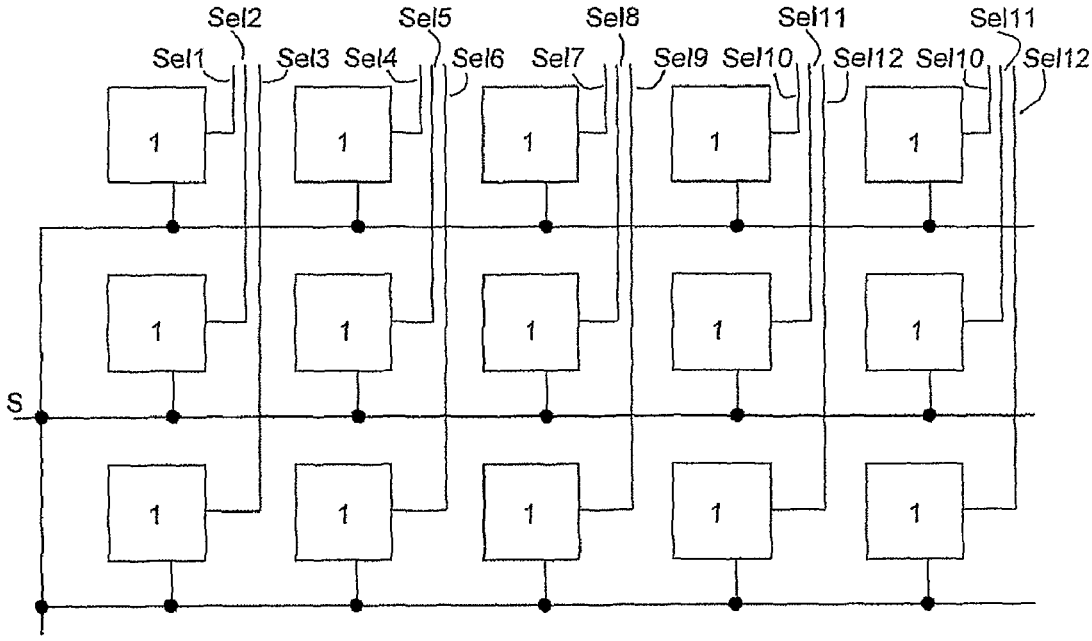
Figure 15:
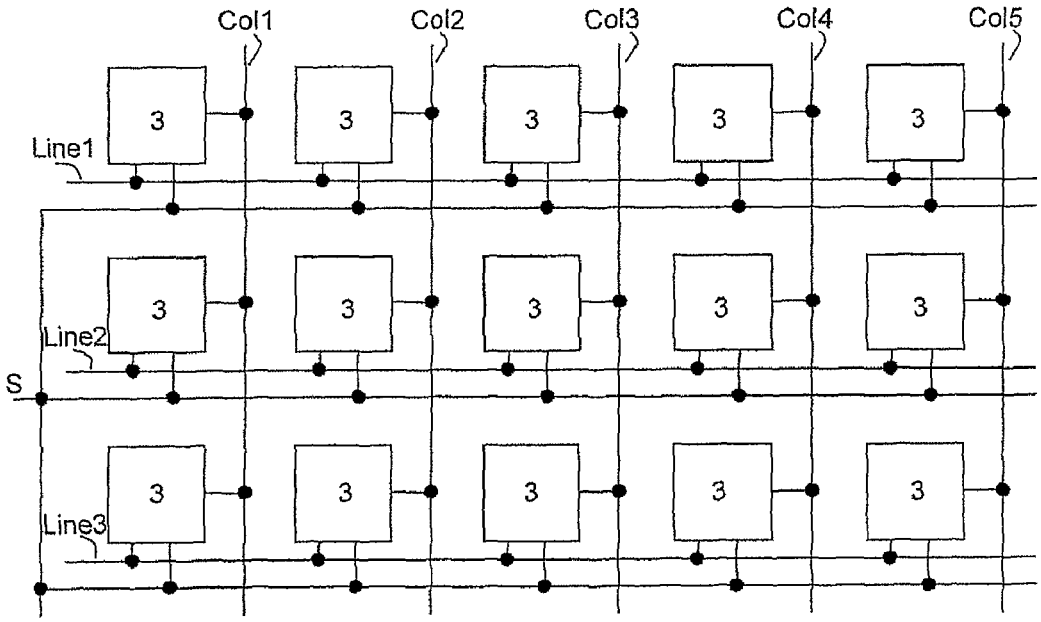
Figure 16:
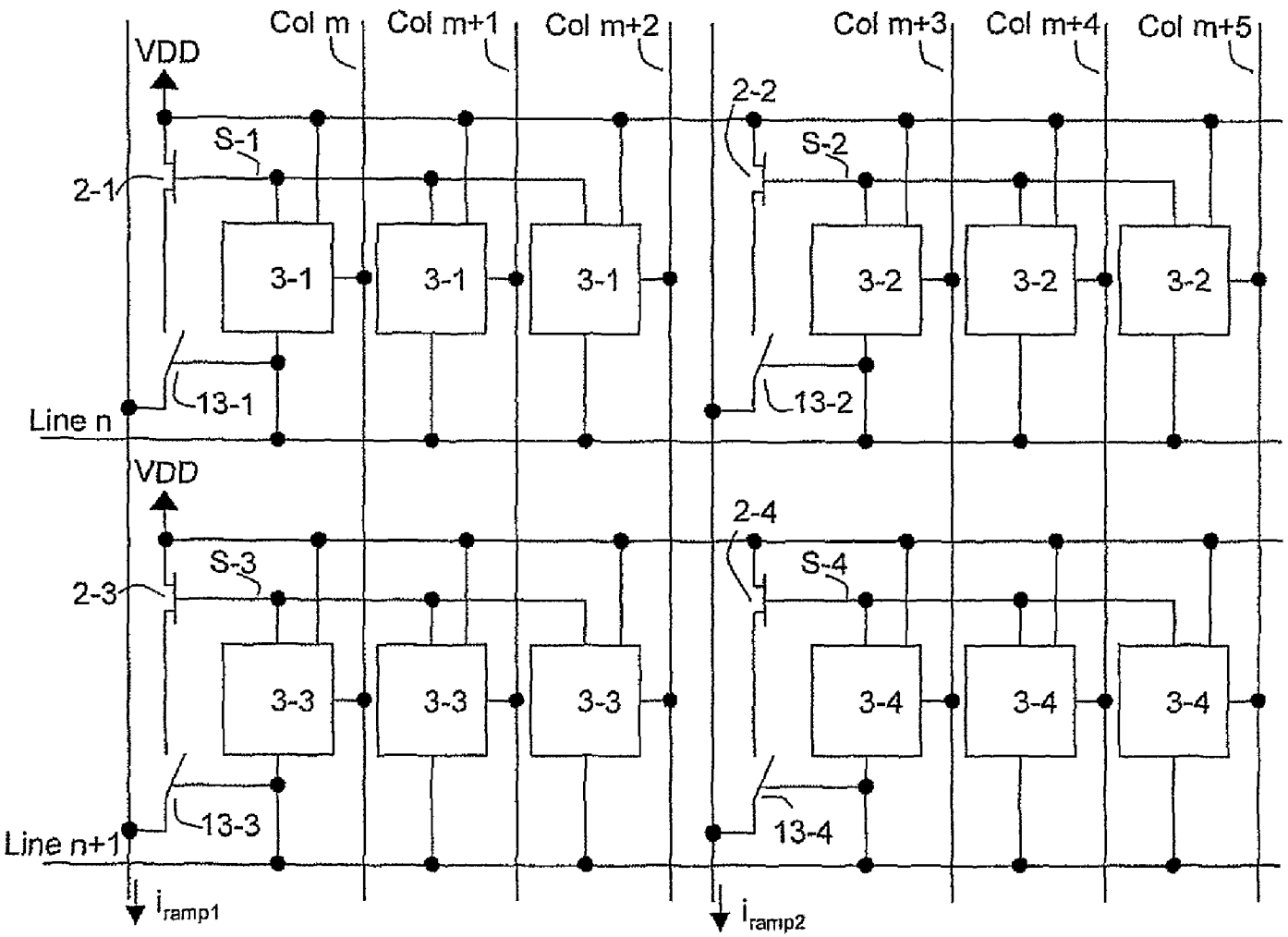
Figure 17:
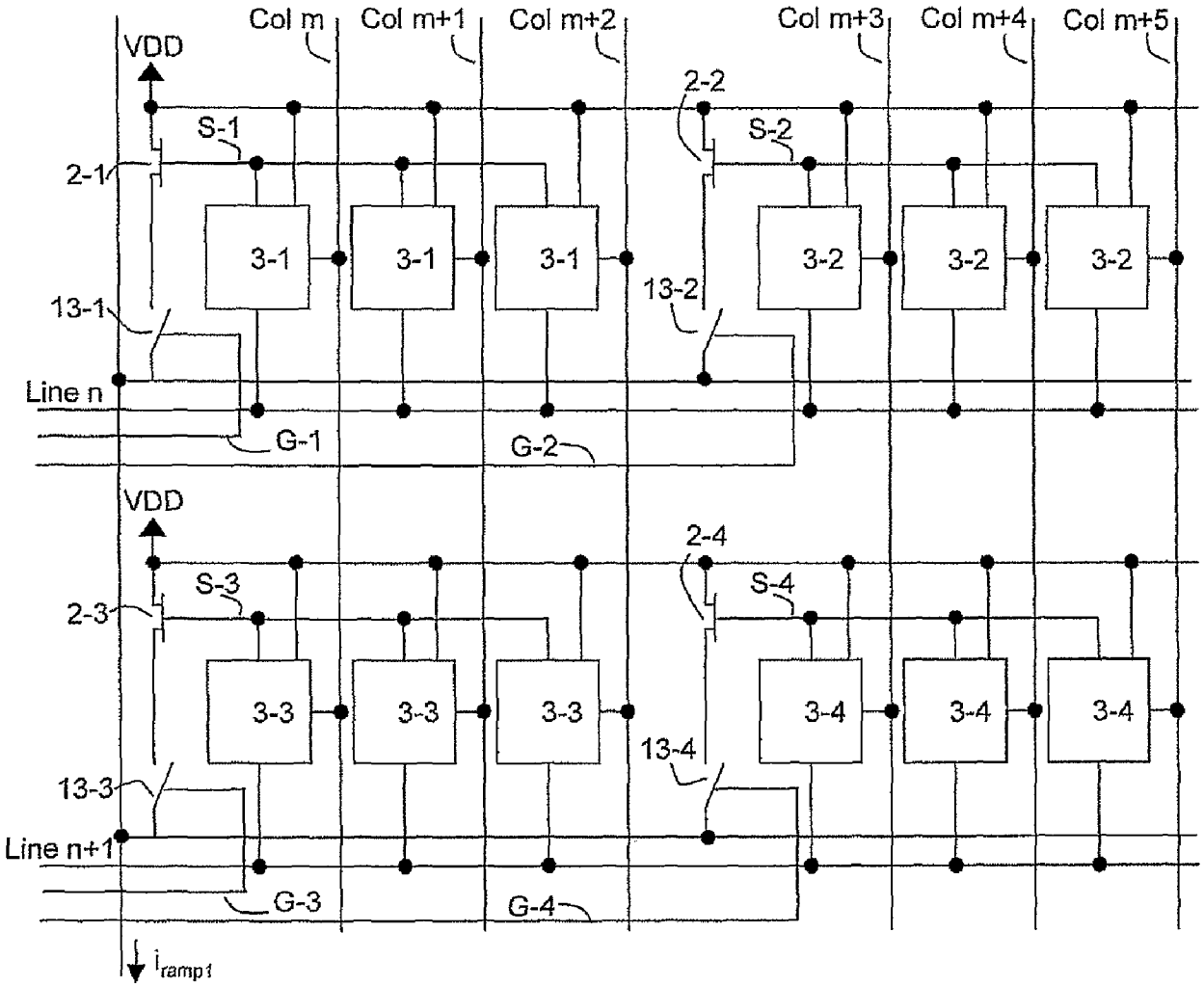

FIG. 11*a* shows a control signal for use with the inventive method;

FIG. 11*b* shows the control signal from FIG. 11*a* in a particular operating state;

FIG. 12 shows a plurality of elements of an inventive light-emitting display which are arranged in a line;

FIG. 13 shows a plurality of inventive elements of a light-emitting display in a matrix arrangement for rendering colour images;

FIG. 14 shows a schematic illustration of the line and column arrangement of an embodiment of elements of a light-emitting display for control using the inventive method;

FIG. 15 shows a schematic illustration of the line and column arrangement of an embodiment of the inventive elements of a light-emitting display;

FIG. 16 shows a partial illustration of a light-emitting display based on the invention; and FIG. 17 shows a partial illustration of a variant of the inventive light-emitting display.

In the figures, the same or similar components or elements have been provided with the same reference symbols. FIGS. 1 to 4 have already been mentioned above in the introduction to the description. They are not explained in more detail below.

Figure 5:
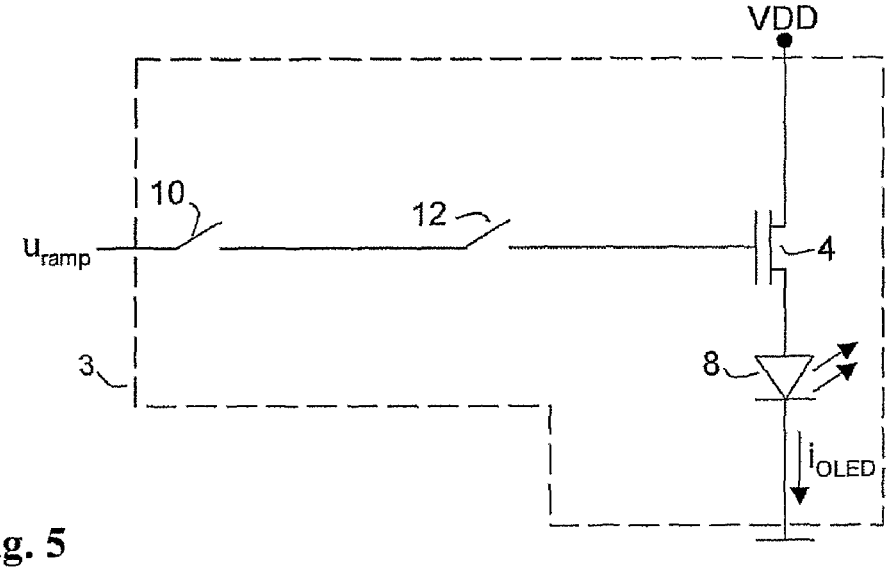
FIG. 5 shows a first embodiment of an inventive circuit for an element of a light-emitting display.

FIG. 5 shows an inventive element of a light-emitting display in schematic form. One connection of a current control means 4 is connected to an operating voltage VDD. A further connection of the current control means 4 is connected to a first connection on a light-emitting means 8. A second connection on the light-emitting means 8 is connected to a ground node. The current control means 4 is a transistor, for example.

In the present exemplary embodiment, the light-emitting means 8 is a light-emitting diode, but the invention is not limited to the use of light-emitting diodes. A control electrode on the current control means 4 is connected to a first control signal $U_{ramp}$ via a first switching means 12 and a second switching means 10. The control signal $U_{ramp}$ is, by way of example, a control voltage as is used in the inventive method. The dashed frame 3 indicates that the components described above form an element of a light-emitting display according to the invention.

The text below describes the inventive method for cyclically driving the element 3 of a light-emitting display which is shown in FIG. 5. The element 3 is part of a light-emitting display which comprises, by way of example, a plurality of elements 3 arranged in lines and columns. First, the two switching means 10, 12 in the element 3 are closed. By way of example, the first switching means 12 is used to select the column and the second switching means 10 is used to select the line in which the element 3 is arranged. Swapping the assignment of the switching means 10, 12 is of no significance to the method. The control signal $U_{ramp}$ is now applied to all second switching means 10. It arrives at the control electrodes of those first current control means 4 in which both of the first and second switching means 10, 12 in the connection to the control electrode are closed. The control signal $U_{ramp}$ is continually increased from a starting value. At a particular time, the luminous flux radiated by the light-emitting element 8 reaches a desired magnitude. At this time, one of the switching means is opened. If lines of the light-emitting display are driven consecutively, the first switching means 12, which selects the column, is opened first. The control signal $U_{ramp}$ is continually increased further until it reaches a predetermined final value. The first switching means 12 in the other elements 3 of the currently driven line are opened correspondingly at respective particular times. The driving cycle for the present line has ended when the control signal $U_{ramp}$ has reached its predetermined final value. All second means 10 associated with the present line are now opened and the inventive method is repeated for the next line. When all lines have been driven, driving begins again at the first line. When the driving sequence is effected in columns, the order in which the switching means are opened is to be swapped accordingly.

The method described above brings about the radiation of light in each light-emitting element 8 of the elements 3 only until one of the two switching means 10, 12 is opened. In order to create an appropriate image impression in the case of an two-dimensional light-emitting display, the luminous flux radiated by each element 3 for a particular time needs to correspond to a desired brightness value for the image. Since the driving brings about the radiation of light only during a portion of the driving cycle for the entire light-emitting display, the luminous flux needs to be correspondingly larger in the short time. The integration of the quantity of light to give a two-dimensional image impression is carried out in the eye of the observer, as already mentioned above. However, the parallel actuation of the elements in a line or column extends the effective lighting time of the elements and reduces the maximum required driving current advantageously as compared with sequential driving of each individual element in the line.

Figure 6:
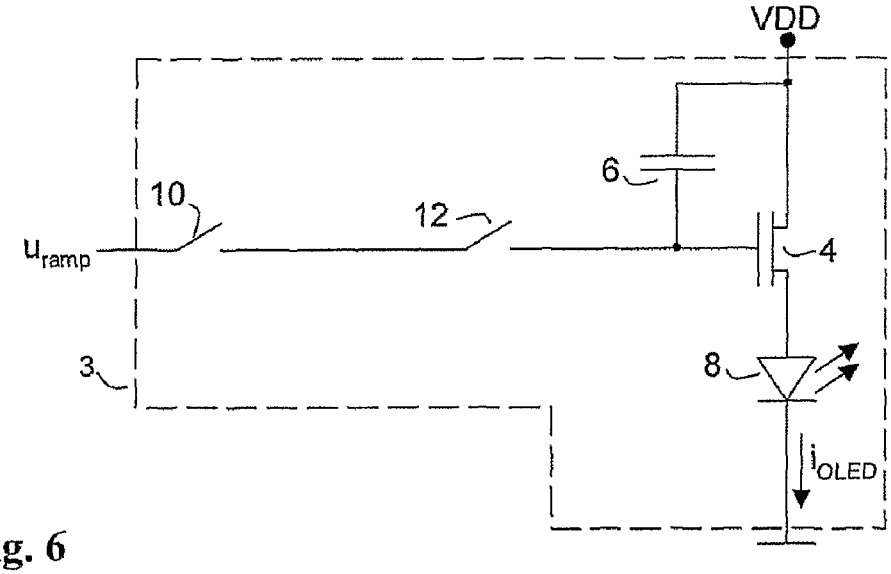
FIG. 6 shows a second embodiment of an inventive element of a light-emitting display.

FIG. 6 shows a further embodiment of an element of a light-emitting display according to the invention. The circuit shown in FIG. 6 largely corresponds to the circuit described in FIG. 5. In addition, a signal holding means 6 is arranged between the control electrode of the first current control means 4 and the operating voltage VDD. The signal holding means maintains the control signal $U_{ramp}$ when one or both switching means 12, 10 are open until both switching means are closed again and a new control signal is applied. By way of example, the signal holding means is a capacitor which maintains a control voltage until a new control voltage is applied. In this context, the period of time during which light is radiated may advantageously be increased further in comparison with the circuit from FIG. 5.

The driving method described for the circuit from FIG. 5 is used in similar fashion for the circuit from FIG. 6. In the case of the method which is to be used here, essentially only the times at which the first switching means 12 are opened need to be altered. Since the signal holding means 6 maintains the flow of current through the light-emitting means 8 until a new cycle applies a new control signal to the control electrode of the respective first current control means, the respective current can be smaller. The integration of the luminous flux which takes place in the eye of the observer can integrate the luminous flux which is smaller on account of the smaller current over a longer period of time and hence can result in the same quantity of light picked up and in the same image impression.

It goes without saying that colour images can be rendered by using elements 3 for the primary colours red, green and blue for additive colour mixing. Other colour combinations are conceivable according to the desired impression. In both cases, groups of corresponding elements 3 of a pixel need to be driven such that the desired colour is produced for each pixel as a result of the colour mixing. The methods described above for FIGS. 5 and 6 can be used in similar fashion.

Figure 7:
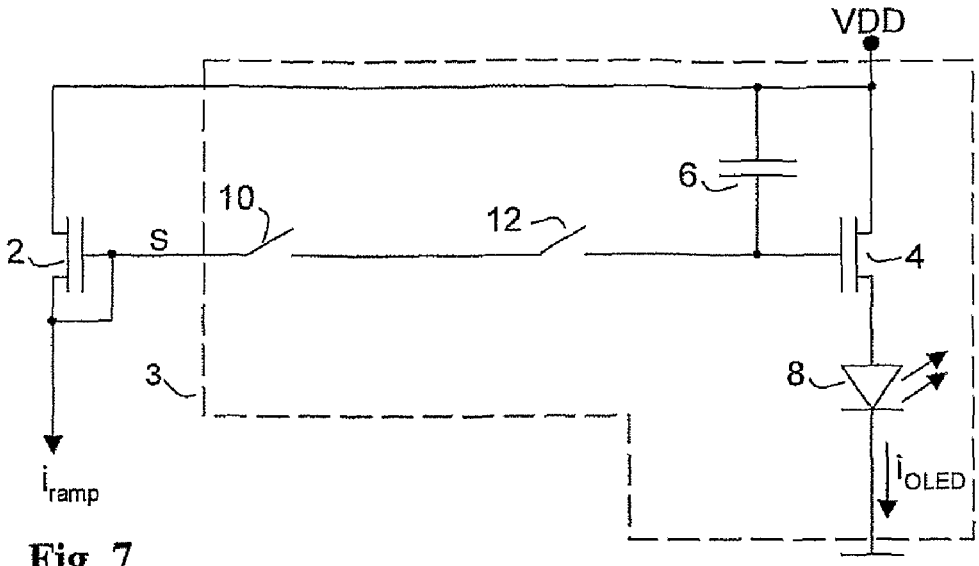
FIG. 7 shows a third embodiment of an inventive element of a light-emitting display.

FIG. 7 shows an element of a light-emitting display according to the invention. The components of the element which are in the frame 3 shown in dashes correspond essentially to the components from FIG. 6. In the case of the embodiment of the inventive element of a light-emitting display which is shown in FIG. 7, the control signal is taken from the control electrode of a second current control means 2. The second current control means 2 is formed in the figure by a transistor, for example by a field effect transistor (FET). When the first and second switching means 12 and 10 are closed, the first and second current control means 4 and 2 form a current mirror circuit. In this case, a current $i_{ramp}$ impressed into the second current control means 2 represents an actuating signal. The impressed current $i_{ramp}$ results in a control potential developing at the control electrode of the second current control means 2 which is applied as control signal S via the first and second switching means 12 and 10 to the control electrode of the first current control means. The impressed current $i_{ramp}$ may, as an actuating signal, also be used in the circuit without signal holding means 6. The switching times of the switching means 10 and 12 then need to be adapted accordingly.

Figure 8:
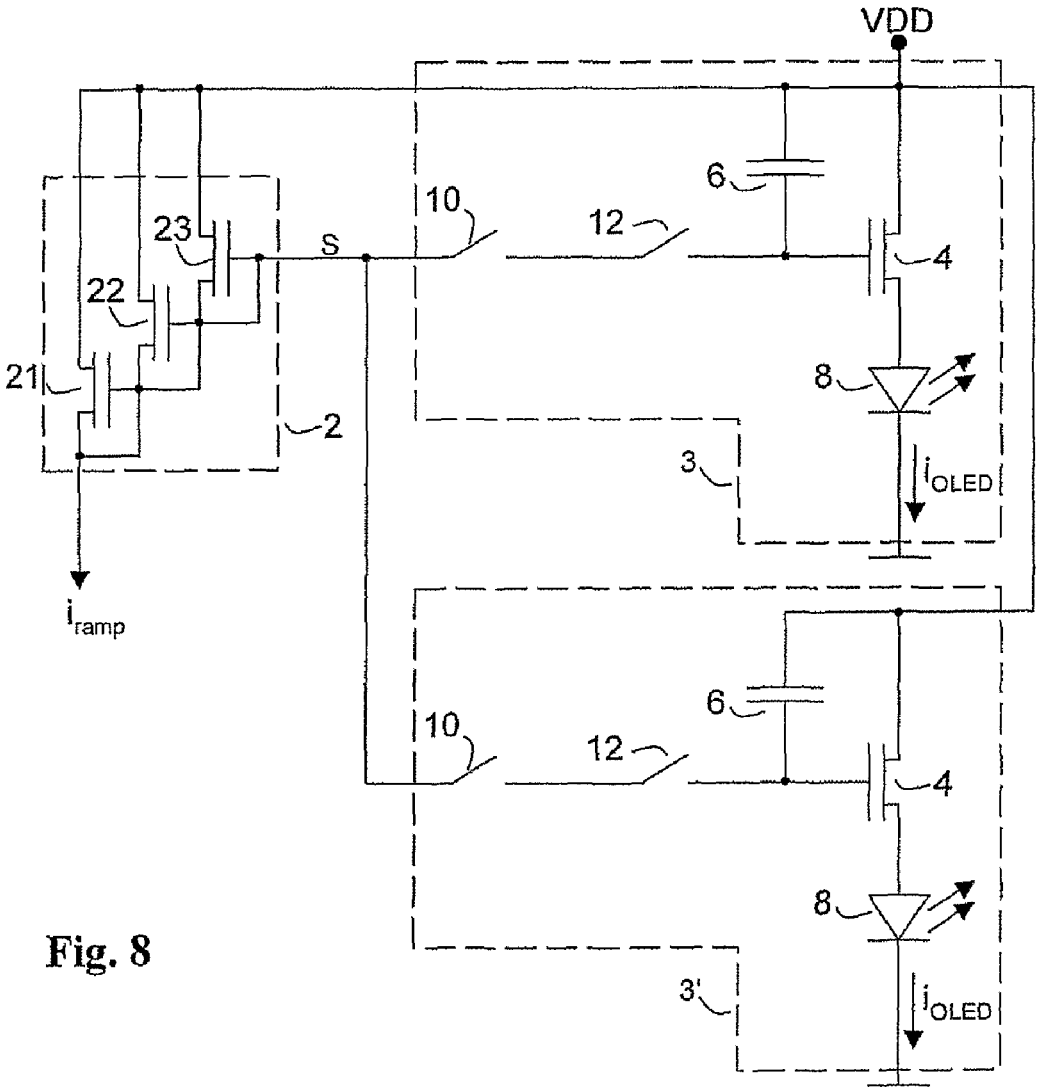
FIG. 8 shows a variant embodiment of the current mirror circuit with elements of an inventive light-emitting display.

The second current control means 2 is shown in FIG. 7 as comprising a single transistor. In order to set a particular ratio of impressed current $i_{ramp}$ to mirrored current $I_{OLED}$, it is also possible for the second current control means 2 to be constructed from a plurality of transistors connected in parallel. This is advantageous particularly when a second current control means actuates a plurality of first current control means. In one preferred embodiment, the transistors have identical properties. FIG. 8 shows this embodiment by way of example. The element 3 corresponds to the element 3 from FIG. 7. The current control means 2 surrounded by the dashed frame is formed by a plurality of interconnected transistors 21, 22, 23 in this example. In addition to the element 3, an element 3' is shown, which is supplied with the control signal S in parallel with the element 3. In FIG. 8, the components of the element 3' correspond, in principle, to the respective components of the element 3 and are denoted by the same reference symbols. If components having different properties are being used, this can be compensated for through appropriate adaptation of the current control means, for example.

FIG. 9 shows a further exemplary embodiment of an element of a light-emitting display. When individual elements 3 are arranged in lines and columns, the first current control means of a plurality of elements in a line and/or in a column can be connected in groups to a common second current control means 2. A third switching means 13 is provided which switchably connects the second current control means 2 to the actuating signal $i_{ramp}$. Preferably, only one second current control means 2 is ever connected to the actuating signal $i_{ramp}$ at any time. The driving method then makes provision, by way of example, first for a line to be selected and then for the groups of elements 3 in the selected line to be actuated in succession.

Upon appropriate driving of the first and second switching means, it is also possible to put the signal holding means directly into a particular state when the third switching means 13 is open. Hence, it is possible to reset the control signals $U_{ramp}$, S for individual or a plurality of elements, for example. By way of example, the resetting is then done by means of the backward diode in one of the field effect transistors used as second current control means 2.

In another embodiment of the inventive element 3, a fourth switching means is associated with the signal holding means 6 as a resetting means, so that the control signal $U_{ramp}$, S held in the signal holding means 6 can be reset in defined fashion. Alternatively, this further switching means (which is not shown in the figures) may be associated with the control connection of the second current control means 2. In this case, the signal holding means 6 in one or more elements 3 can be advantageously reset using a single resetting means by switching the corresponding first and second switching means of the elements 3 in an appropriate order. By way of example, the resetting means may dissipate a charge stored in a capacitor acting as signal holding means 6 to earth or to the operating voltage VDD.

FIG. 10 shows a specific embodiment of the circuit from FIG. 7. In this context, the first and second switching means 12 and 10 are provided by transistors 16 and 14. The control electrode of the transistors is supplied with a respective signal Sel1_1 and Sel1_2.

FIG. 11*a* shows an exemplary schematic characteristic curve for one cycle of the control signal for an element of a light-emitting display according to the invention and for use in the inventive method. The figure shows a current $i_{prog}$ which constantly rises from a starting value at t0 over time or a voltage $u_{prog}$ which constantly rises from a starting value. The ordinate in FIG. 11*a* is the time axis. The constant rise in the control signal ends at time t1, at which a new driving cycle for the element of the light-emitting display starts. The curve shape for the control signal does not necessarily have to correspond to the sawtooth shape shown in the figure. In this context, any constantly rising signals are conceivable, for example an exponential or logarithmic rise. In addition, it is not absolutely necessary to have the start of a cycle following the end of a cycle directly. It is likewise conceivable for there to be an idle time between the end of a cycle and the start of a new cycle. In this case, the idle time may either be at the start or at the end of a cycle. In the case of an idle time at the start of a cycle, the output signal is held, otherwise the respectively set signal is held.

The inventive control signal can be produced, by way of example, using an appropriately controlled digital/analog converter or an appropriately controlled pulse-width or pulse-density modulator. To this end, a control circuit generates pulses of particular length and of fixed frequency or pulses of fixed length and variable frequency which are integrated and then form the control signal. In the case of generation by means of pulse-width or pulse-density modulation, the pulsed control signal needs to be smoothed using suitable filters. Alternatively, it is possible to generate the control signal using an analog circuit, in the case of the described sawtooth shape for example using a constant current source, which charges a capacitor, and a switch, which discharges the capacitor at the end of the cycle. In this case, a digital/analog converter is not required for actuation, but rather just switching lines which apply signals to the first and second switching means 12 and 10. In a development of the above circuit, an analog/digital converter is provided which samples the control signal and transfers the respective sampled value to a control circuit. The control circuit uses the sampled instantaneous value to generate the control signals for the first and second switching means. In this way, it is advantageously possible to compensate for unwanted fluctuations during signal generation.

FIG. 11*b* shows an exemplary profile of the control signal on the control electrode of the first current control means. The control signal follows the profile of the control signal from FIG. 11*a* by virtue of the closed first and second switching means 12 and 10. At time t2, one of the first or second switching means 12 or 10 opens and the signal holding means 6 holds the magnitude of the control signal at this time $u/i_1$ on the control electrode of the first current control means constant. At the end of an elapsed cycle at t1 and hence at the start of a new cycle, all switching means 12 and 10 are closed again and the control signal rises constantly from an initial value again. If there is an idle time between two cycles, all current control means are put into a defined state during this time, for example. In one variant of the driving method, the idle time is relatively long in relation to the cycle time. In this case, the elements of the light-emitting display are set within a short time. For a large portion of the idle time at the end of the actuation cycle, the signal holding means of the elements maintain the luminous flux which has been set. Only at the end of the idle time and prior to the start of a new driving cycle are the elements put into a defined initial state. The long period of time without changes in relation to the setting time allows a steadier image impression to be achieved. To improve understanding, the figure described above has not illustrated any transient operations, which may arise in real circuits.

FIG. 12 shows a portion of a light-emitting display with a plurality of inventive elements 3. In the illustration, the elements 3 contain first current control means 104, 204, 304. A current $i_{OLED1}$, $i_{OLED2}$, $i_{OLED3}$ flowing from a supply voltage VDD through the current control means 104, 204, 304 flows through light-emitting elements 108, 208 and 308 to earth. The control electrodes of the current control means 104, 204, 304 have signal holding means 106, 206, 306 connected to them. A control signal S is supplied to the control electrodes of the current control means 104, 204, 304 via respective first and second switching means 114, 116, 214, 216 and 314, 316. The first and second switching means of the elements 3 are controlled by switching signals Sel1 to Sel6. The elements 3 are respectively indicated by dashed frames. The control signal S is tapped off from the control electrode of a second current control means 102. When the switching means 114, 116, 214, 216, 314, 316 are closed, the second current control means 102 forms a respective current mirror circuit together with the respective first current control means 104, 204, 304 of the elements 3. In this case, the control signal S is produced by a control current $i_{ramp}$ which is impressed into the second current control means 102.

FIG. 13 shows a plurality of inventive elements of a light-emitting display in a matrix arrangement for rendering colour images. Altogether, six inventive elements 3 are shown in FIG. 13. The elements 3 are respectively surrounded by dashed frames. Each of the elements 3 essentially corresponds to the elements from FIG. 10. In this example, three elements 3 are provided for one pixel for the purpose of rendering colour images, with one respective element 3 being provided for each of the primary colours red, green and blue. FIG. 13 shows two pixels comprising three respective elements 3. A control signal S is applied to a control input on a second current control means 402. The control signal is produced by an impressed current $i_{ramp}$ through the second control current means 402. Each of the elements 3 has a first and a second switching means 416, 414, 516, 514, 616, 614, 716, 714, 816, 814 and 916, 914. The initially closed first and second switching means in the elements 3 connect the control electrodes of first current control means 404, 504, 604, 704, 804 and 904 in the elements 3 in a respective current mirror arrangement to the second current control means 402. The two pixels formed by three respective elements 3 are situated, by way of example, in a line of a light-emitting display which is formed from a plurality of pixels arranged in lines and columns. A control input Line is used for respectively controlling the first switching means 416, 516, 616, 716, 816 and 916 in the elements 3 in parallel. The respective second switching means 414, 514, 614, 714, 814 and 914 in the elements 3 are controlled by means of individual switching signals Sel1_R, Sel1_G, Sel1_B, Sel2_R, Sel2_G and Sel2_B.

In a development of the circuit from FIG. 13, the current control means for the respective colours are in a form such that a different sensitivity of the light-emitting means for the individual colours is taken into account. Hence, a single control signal S may be used to actuate the respective light-emitting means for the various colours in optimum fashion. In this case, one possible implementation of this development makes use of the properties of the current mirror circuit which were described in FIG. 4. The respective light-emitting means for the various colours are in this case assigned current control means which reproduce the reference current in a weighting with a respective particular factor.

Figure 1:
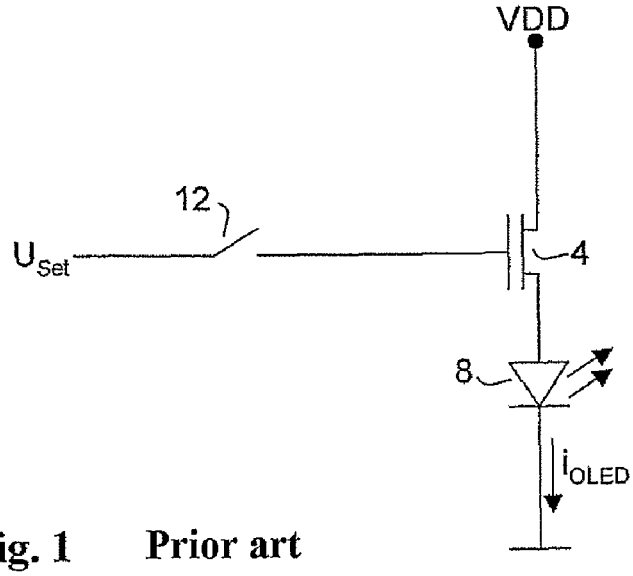
Fig. 1 Prior art
Figure 2:
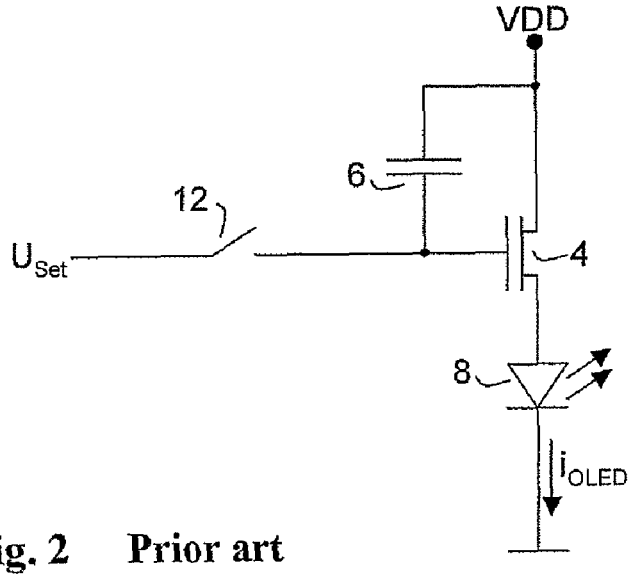
Fig. 2 Prior art
FIG. 2 shows a further known circuit for an element of a light-emitting display.
Figure 3:
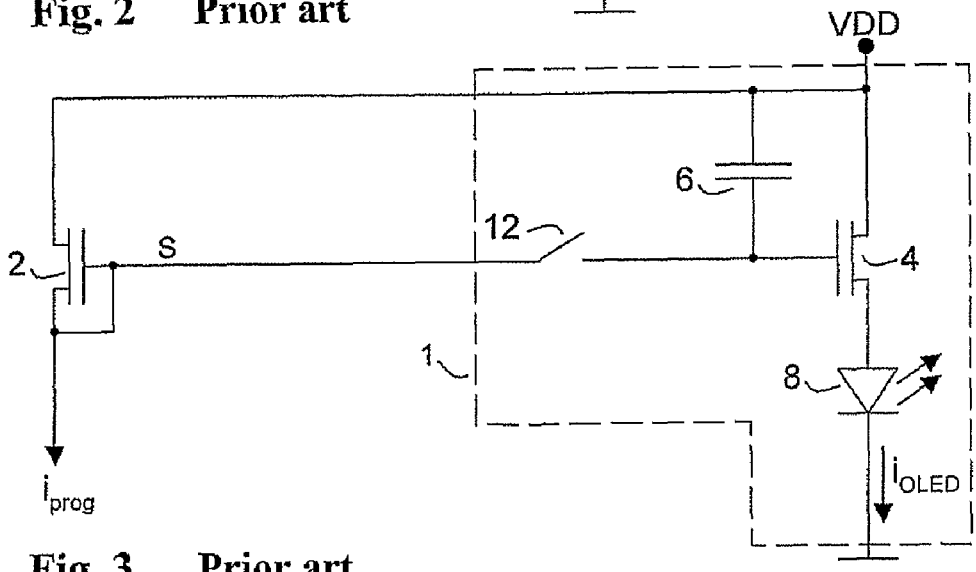
Fig. 3 Prior art
FIG. 3 shows a third known circuit for an element of a light-emitting display.
Figure 4:
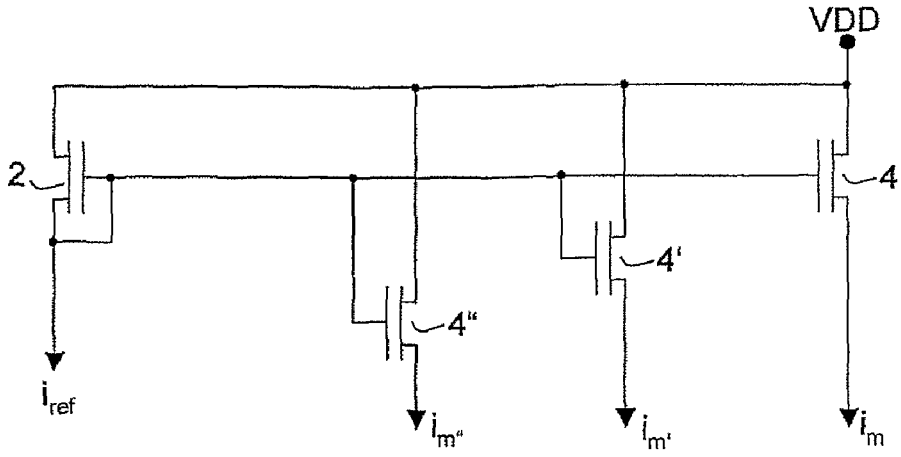
Fig. 4 Prior art
FIG. 4 shows a current mirror circuit as is known from the prior art.

FIG. 14 shows a plurality of elements 1 of a light-emitting display which are arranged in lines and columns. The elements 1 correspond to the elements known from the prior art which are shown in FIGS. 1 and 2. A control signal S according to the invention is supplied to all elements 1 in parallel. Each of the elements is also connected to an individual switching signal Sel1 to Sel15.

The inventive method for actuating this light-emitting display is based essentially on the method described in FIG. 5. The constantly rising control signal S is supplied to all elements 1 of the light-emitting display simultaneously. Each of the elements 1 corresponds to the element 1 from FIG. 3, for example, and comprises a switching means 12, inter alia. The respective switching means 12 in the elements 1 are initially all closed. A cycle of the inventive control signal S is then started. At particular times, the respective switching means 12 in the individual elements 1 are opened, so that all of the elements 1 render a desired image. In this context, a new actuation cycle does not start after the driving of a line or of a column, but rather after the driving of a complete image.

It is also conceivable for the elements 1 not to have any signal holding means 6. The method for actuation then corresponds essentially to the method described above. Only the times at which the respective switching means are opened differ.

The methods described above with reference to FIG. 14 are particularly suitable when the light-emitting display comprises a smaller number of pixels or elements. In this case, it is advantageous to dispense with special column and line actuation. The method and the circuit are not limited to small luminescent displays, however.

FIG. 15 shows a portion of a light-emitting display which comprises inventive elements 3 arranged in lines and columns. The elements 3 have an inventive control signal S supplied to them in parallel. In addition, the elements 3 arranged in a line are respectively supplied in parallel with a switching signal Line1, Line2 and Line3. Similarly, the elements 3 arranged in a column are respectively supplied in parallel with a switching signal Col1 to Col5. A suitable combination of the switching signals for lines and columns can thus be used for individually driving each element 3.

This light-emitting display involves the use of a method for actuation as described in FIG. 5 or 6. At the start of a driving cycle, all switching means in the elements 3 in a line or column are closed. The individual elements are initially driven together in respective lines or columns by the control signal S, until individual switching means 10, 12 in the elements 3 interrupt the connection to the control signal S in appropriate columns or lines. It is thus possible to drive all elements 3 in the light-emitting display individually. To carry out a preferred variant of the method, a line of the light-emitting display is first selected using the appropriate switching signal Line1, Line2, Line3. All columns are then selected using the appropriate switching signal Col1 to Col6. The inventive control signal S is then applied to all elements 3. However, it reaches only the control electrodes of those first current control means 4 which are arranged in elements in the selected line. Whenever a particular desired signal value is reached, the switching signals for the columns interrupt the connection between the control signal S and individual elements 3. The control signal S continues to rise constantly until it reaches a predetermined final value. The actuation cycle for the selected line is then at an end. A new line is selected and the method is executed from the beginning. When all lines of the light-emitting display have been actuated in succession, the actuation starts again from the beginning in the first line.

FIG. 16 shows part of a development of the light-emitting display from FIG. 15. In the inventive light-emitting display, a respective plurality of elements 3-1, 3-2, 3-3 and 3-4 are combined in groups. The elements correspond to the elements described for FIG. 10, for example. Each group has a respective second current control means 2-1, 2-2, 2-3 and 2-4 switchably associated with it via switching means 13-1, 13-2, 13-3 and 13-4. The switching means are supplied with a respective line control signal Line n or Line n+1 which is also applied to the corresponding switching means of the elements 3-1, 3-2, 3-3 and 3-4. In the exemplary illustration, the adjacent groups with the group index -1 and -2 are connected to the same line control signal Line n. The adjacent groups with the group index -3 and -4 are connected to the line control signal Line n+1. The vertically arranged groups with the group index 3-1 and 3-3 and also 3-2 and 3-4 are connected to driving signals $i_{ramp1}$ and $i_{ramp2}$. In addition, each of the elements 3-1, 3-2, 3-3 and 3-4 is also supplied with a column control signal Col m to Col m+5 and a control signal S-1, S-2, S-3 or S-4.

In the case of driving in a line-by-line fashion, a line is first selected using the line control signal Line. This closes the switching means 13 for the respective line. The corresponding switching means for line selection of the elements 3 arranged in the selected line are likewise closed. After that, the switching means for column selection of the elements 3 are also closed. In the selected line, all elements 3 are now connected to respective control signals S which are applied to a control electrode on the respective current control means 2. A driving signal $i_{ramp1}$, $i_{ramp2}$ applied to corresponding conductors is sent to those second current control means which are connected to the conductors via the closed switching means 13. This ensures that each driving signal $i_{ramp1}$, $i_{ramp2}$ is applied only to one respective group of elements 3. The switched disconnection of further elements and of the associated connecting conductors reduces the capacitive loading of the driving signals $i_{ramp1}$, $i_{ramp2}$. In the case of very small driving signals, capacitive loading may result in corruptions in the signals. The driving signals $i_{ramp1}$, $i_{ramp2}$ respectively bring about constantly rising control signals S. When a desired luminous flux is achieved for the respective elements 3, the column control signals Col m to Col m+5 open corresponding switching means in the elements 3. When a predetermined final value for the driving signals $i_{ramp1}$, $i_{ramp2}$ is reached, a new driving cycle starts, for example in the next line in the case of parallel driving of lines.

The number of elements combined in groups is not fixed at three. In principle, it is possible to combine any numbers of elements into groups. It is therefore also possible for each element 3 to be assigned an individual second current control means 2, i.e. to form a group comprising just one element. In this case, the number of control conductors naturally increases, but also greater degrees of freedom are obtained for driving of individual elements.

It is also possible to produce just the drive signal $i_{ramp1}$, and to apply it to the conductor for the second actuating signal $i_{ramp2}$, for example via a multiplexer. The groups are then driven, by way of example, not in parallel in lines but rather sequentially in lines.

FIG. 17 shows a detail from a further embodiment of the inventive light-emitting display. As described above for FIG. 16, a respective plurality of elements 3-1, 3-2, 3-3 and 3-4 are combined into groups with group indices -1, -2, -3 and -4. The groups of elements have respective associated second current control means 2-1, 2-2, 2-3 and 2-4. The elements 3-1, 3-2, 3-3 and 3-4 in the groups are also supplied with control signals S-1, S-2, S-3 and S-4, line control signals Line n and Line n+1 and column control signals Col m to Col m+5. The second current control means are switchably connected to a conductor for the drive signal $i_{ramp1}$ via respective switching means 13-1, 13-2, 13-3 and 13-4. In this case, the switching means 13-1, 13-2, 13-3 and 13-4 are supplied with individual switching signals G-1 to G-4. In the case of groups which are arranged in lines and columns, it is thus possible to select any group individually, which means that the single drive signal $i_{ramp1}$ can be supplied to all groups individually.

With appropriate switching of the individual switching means in the element 3, the embodiment in FIG. 17 allows the signal S stored in the elements' signal holding means 6 to be erased independently of the line selection.

In this embodiment too, the number of elements 3 in a group is not fixed at three. It may assume any appropriate values.

In addition, a plurality of drive signals $i_{ramp1}$, $i_{ramp2}$ may also be used in this embodiment, as were described for FIG. 16. This results in further degrees of freedom for driving.

In a preferred embodiment of the light-emitting display in FIGS. 16 and 17 for rendering colour, the respective subpixels (associated with a pixel) for the primary colours red, green and blue are combined in a group.

When a plurality of elements driven in groups using a second current control means, it is advantageously possible to use the interconnection of a plurality of current control means, as illustrated in FIG. 8. It is also conceivable, however, for the interconnected current control means 21, 22, 23 shown in FIG. 8 to be assigned directly to the respective elements 3. The physically close association further improves the desired close coupling of the electrical properties of the first and second current control means.

The circuits described above for elements in light-emitting displays, the light-emitting displays and the associated method and its modifications are not just suitable for sequentially actuating lines or columns. A line interlacing method may also be used for actuation. This advantageously results in compatibility with existing standards for image transmission, with no image sections being buffer-stored. Further particular driving patterns are conceivable, for example with columns actuated simultaneously from both sides towards the centre.

The embodiments of the current control means in the circuit which have been described above with reference to the figures are designed using p-channel field effect transistors. Alternatively, the circuits can be designed using n-channel field effect transistors. The control signal and the arrangement of the signal holding means and also of the light-emitting means then need to be adapted accordingly.

The use of field effect transistors for the current control means is advantageous if the signal holding means 6 is a capacitor, for example. If no such signal holding means 6 are provided, it is also conceivable to use bipolar transistors.

In the embodiments described above, transistors have been used for the switching means, in which case both bipolar transistors and field effect transistors may be used for switching. The inventive circuit is not limited to transistors as switches, however. It is also conceivable to use mechanical, micromechanical, magnetic or optical switches.

In principle, the circuit and the method are suitable for any light-emitting means which can have their luminous flux controlled unambiguously by means of a current. The invention is not limited to the OLEDs or light-emitting diodes (LEDs) cited in the description of the embodiments.

The idle time between two driving cycles which was described above for one method variant is not limited to this variant. An idle time between two cycles may be provided for all of the methods described above.

The fourth switching means as resetting means, which was described above for an embodiment of an element 3, and the corresponding control may advantageously be used for all embodiments with signal holding means 6.

The invention claimed is:

1. A light emitting display including a multiplicity of elements arranged in rows and columns, wherein each elements includes a light-emitting means which emits light when a current flows through the light-emitting means, a first current control means which is connected in series with the light-emitting means, and a first and a second switching means which are arranged between a control signal line and a control electrode of the first current control means, wherein the control signal line is connected to one end of the series connection of the first and second switching means of a multiplicity of elements, wherein a control electrode of a second current control means is connected to the control signal line such that the first current control means of a multiplicity of elements and the second current control means connected to the control signal line at least temporarily form a corresponding multiplicity of current mirror circuits connected in parallel when the respective first and second switching means of the multiplicity of elements are conducting, and wherein the first and the second switching means are opened or closed responsive and second logical switching signals, which first and second logical switching signals are connected to a multiplicity of elements in a line or a column, respectively.

2. The light emitting display of claim 1, wherein a drive signal cyclically rising from a predetermined starting value to an end value is switchably supplied to the second current control means via third switching means, wherein the control signal supplied to the control electrode of the first current control means is dependent on the drive signal.

3. The light emitting display of claim 1, wherein a signal holding means is connected to the control electrode of the first current control means wherein the control signal is maintained when the first and/or second switching means interrupts the connection of the control signal line and the control electrode of the first current control means.

4. A method of operating a light emitting display including a multiplicity of elements arranged in rows and columns, wherein each elements includes a light-emitting means which emits light when a current flows through the light-emitting means, a first current control means which is connected in series with the light-emitting means, and a first and a second switching means which are arranged between a control signal line and a control electrode of the first current control means, wherein the control signal line is connected to one end of the series connection of the first and second switching means of a multiplicity of elements, and wherein a control electrode of a second current control means is connected to the control signal line such that the first current control means of a multiplicity of elements and the second current control means connected to the control signal line form a corresponding multiplicity of current mirror circuits connected in parallel when the respective first and second switching means of the multiplicity of elements are conducting, and wherein the first and the second switching means are opened or closed responsive to a respective first and second logical switching signal, which first and second logical switching signals are connected to a multiplicity of elements in a line or a column, respectively, wherein the method includes the following steps:

closing the first switching means of a first multiplicity of elements arranged in a line at the start of a driving cycle in response to the first logical switching signal that is connected to said first multiplicity of elements;

closing the second switching means of a second multiplicity of elements arranged in a column before or after closing the first switching means in response to the second logical switching signal that is connected to said second multiplicity of elements, wherein the first and second multiplicity of elements have at least one element in common;

applying a current to the second current control means, thereby generating a control signal that is, via the control signal line, applied to the control electrodes of the first current control means of those elements of said multiplicity of elements, the respective first and second switching means of which are closed, which control signal rises constantly from a predetermined starting value, and which control signal causes a corresponding current flow in the first current control means;

opening the first or the second switching means in response to the first or the second logical switching signal, respectively, when the luminous flux emitted by the light-emitting means reaches a desired magnitude;

opening the second or the first switching means in response to the second or the first logical switching signal, respectively after the end of the driving cycle; and initiating a new cycle when the applied control signal reaches a predetermined final value.

5. The method of claim 4, wherein the method includes actuating a plurality of light-emitting elements in a column or in a line in parallel and actuating the columns or lines sequentially.

6. The method of claim 4, wherein an idle time is provided between two cycles.

7. The method of claim 4, further including:

sampling the magnitude of a control signal applied to the second current control means that is operatively connected to a multiplicity of first current control means of those elements the first and second switching means of which are closed;

applying the sampled instantaneous value to a control circuit, wherein the control circuit generates the logical switching signals for the first and second switching means in response to the sampled instantaneous value.

8. A light emitting display including a multiplicity of elements arranged in rows and columns, wherein each elements includes a light-emitting means which emits light when a current flows through the light-emitting means, a first current control means which is connected in series with the light-emitting means, and a first and a second switching means which are arranged between a control signal line and a control electrode of the first current control means, wherein the control signal line is connected to one end of the series connection of the first and second switching means of a multiplicity of elements, wherein a controllable voltage source provides a control signal cyclically rising from a predetermined starting value to an end value that, the control signal being applied to the control signal line such that the control electrodes of the multiplicity of the first current control means are at least temporarily connected in parallel when the respective first and second switching means are conducting, wherein the first and the second switching means are opened or closed responsive to respective first and second logical switching signals, which first an second logical switching signals are connected to a multiplicity of elements in a line or a column, respectively.

9. The light emitting display of claim 8, wherein a signal holding means is connected to the control electrode of the first current control means wherein the control signal is maintained when the first and/or second switching means interrupts the connection of the control signal line and the control electrode of the first current control means.

10. The circuit of claim 1 or 8, wherein an analogue-to-digital converter is provided for sampling the magnitude of a control signal applied to the second current control means that is operatively connected to a multiplicity of first current control means of those elements the first and second switching means of which are closed, wherein the sampled instantaneous value is applied to a control circuit, and wherein the control circuit is adapted to generate the logical switching signals for the first and second switching means in response to the sampled instantaneous value.

11. The circuit of claim 1 or 8, wherein light emitting means for individual colors have different sensitivity, wherein the control electrode of a single second current control means is connected to first current control means of elements producing different colors, wherein the first current control means of elements for different colors mirror the reference current applied to the second current control means in a weighted fashion for taking into account the different sensitivity of the light emitting means for the individual colors.

* * * * *